US006202666B1

(12) United States Patent
Rehbein

(10) Patent No.: US 6,202,666 B1
(45) **Date of Patent: *Mar. 20, 2001**

(54) TENT WITH A PHOTOGRAPHIC PANORAMIC FACSIMILE OF A REAL SPACE ON ITS SURFACE

(76) Inventor: Jürg Rehbein, 574 W. End Ave., New York, NY (US) 10024

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/939,901

(22) Filed: Sep. 29, 1997

(51) Int. Cl.[7] ..... A45F 1/04

(52) U.S. Cl. ..... 135/115; 135/135; 472/74; 40/538

(58) Field of Search ..... 135/124, 135, 135/136, 156, 115, 33.2, 137, 147, 148; 40/427, 442, 538, 603; 446/478; 472/57–61, 74, 136; 434/284–293

(56) References Cited

U.S. PATENT DOCUMENTS

| | | | | |
|---|---|---|---|---|
| D. 88,727 | * | 12/1932 | Metzner | 434/289 |
| D. 235,281 | | 6/1975 | Madison et al. . | |
| D. 267,811 | | 2/1983 | Grebe . | |
| D. 337,366 | | 7/1993 | Baker . | |
| D. 379,522 | | 5/1997 | Rushford et al. . | |
| 887,803 | | 5/1908 | Henzi . | |
| 892,070 | | 6/1908 | Murphy . | |
| 904,253 | * | 11/1908 | Forster | 472/57 |
| 981,672 | * | 1/1911 | Napp | 472/59 |
| 1,916,714 | | 7/1933 | Burke . | |
| 2,475,515 | | 7/1949 | Potter . | |
| 2,608,726 | | 9/1952 | Olson . | |
| 2,684,243 | | 7/1954 | Alston . | |
| 2,855,701 | | 10/1958 | Roos . | |
| 2,941,333 | | 6/1960 | Kudlik . | |
| 2,955,606 | | 10/1960 | Walker . | |
| 3,002,752 | | 10/1961 | Roth . | |
| 3,003,260 | | 10/1961 | Bassetti . | |
| 3,315,959 | | 4/1967 | Carnielli . | |
| 3,338,001 | | 8/1967 | Fraser . | |
| 3,387,412 | | 6/1968 | Kwake . | |
| 3,486,242 | | 12/1969 | Aronson . | |
| 3,618,256 | | 11/1971 | Monks . | |
| 3,970,096 | * | 7/1976 | Nicolai | 135/115 X |
| 4,068,418 | | 1/1978 | Masse . | |
| 4,102,352 | * | 7/1978 | Kirkham | 135/115 X |
| 4,129,123 | | 12/1978 | Smidak . | |
| 4,171,595 | | 10/1979 | Tucker . | |
| 4,192,333 | * | 3/1980 | Sato | 135/124 |
| 4,195,651 | * | 4/1980 | Watts et al. | 135/135 |
| 4,304,068 | * | 12/1981 | Beder | 135/135 X |
| 4,327,520 | | 5/1982 | Saxby et al. . | |
| 4,556,391 | | 12/1985 | Tardivel et al. . | |
| 4,597,401 | | 7/1986 | Fournier . | |
| 4,709,718 | * | 12/1987 | Nichols | 135/115 X |
| 4,766,918 | * | 8/1988 | Odekirk | 135/136 X |
| 4,953,848 | * | 9/1990 | Braunstein et al. | 40/538 |
| 5,002,083 | * | 3/1991 | Kim | 135/135 X |

(List continued on next page.)

FOREIGN PATENT DOCUMENTS

| | | | | |
|---|---|---|---|---|
| 2251798 | * | 6/1975 | (FR) | 135/115 |
| 6413794 | * | 5/1965 | (NL) | 135/33.2 |

OTHER PUBLICATIONS

Serengeti Catalog, Spring/Summer 1994, p. 27.*

*Primary Examiner*—Richard Chilcot
(74) *Attorney, Agent, or Firm*—Pennie & Edmonds LLP

(57) ABSTRACT

A tent having a panoramic image displayed thereon and method for making same. An observer inside the tent is surrounded by a panoramic or continuous image, giving him the illusion of being in the space represented by the image. The image is applied to flat two-dimensional sections which are attached together to form the three-dimensional tent.

18 Claims, 13 Drawing Sheets

U.S. PATENT DOCUMENTS

| | | | | |
|---|---|---|---|---|
| 5,010,909 | | 4/1991 | Cleveland . | |
| 5,345,961 | | 9/1994 | Yercha et al. . | |
| 5,352,149 | * | 10/1994 | Melashenko et al. | 446/478 |
| 5,407,392 | | 4/1995 | Laijoki-Puska . | |
| 5,425,677 | | 6/1995 | Gleeson et al. . | |
| 5,482,510 | * | 1/1996 | Ishii et al. | 472/61 |
| 5,487,400 | | 1/1996 | Dawkins . | |
| 5,839,705 | * | 11/1998 | LaMotte | 40/603 |

* cited by examiner

TENT WITH A PHOTOGRAPHIC PANORAMIC FACSIMILE OF A REAL SPACE ON ITS SURFACE

BACKGROUND

1. Field of the Invention

The present invention relates to the field of tents having an illusory effect on observers. The tent surrounds the observer with a panoramic or continuous image which virtually transports the observer to another place or space. This invention also relates to the field of dioramas. Heretofore panoramic spaces have been either painted on rigid surfaces as domes or cupolas, or projected by means of film or slide projectors with wide-angle lenses onto rigid dome-like surfaces. The present invention, by contrast, is constructed from flat sections which are attached together to form the desired shape. This invention has only recently become feasible in the last two years due to advancements in digital printing technology, which enable photographic printing on large substrates or surfaces, including the flat sections which form the tent of the present invention. Also various photographic retouching software has recently been developed which enables one to manipulate original photographs or portions of original photographs before printing them onto the substrates.

2. Description of Prior Art

Myriads of tents having various designs are on the market today. Only a few provide illusory effects. For example, U.S. Pat. No. 5,010,909 to Cleveland discloses a knock-down deer blind, and U.S. Des. Pat. No. 337,366 to Baker discloses a hunting blind. These blinds are intended to camouflage the inhabitant of the blind, and they are not meant to be viewed from the inside of the blind. Both blinds may include an outside surface design to effect the camouflage. However, neither the Cleveland nor the Baker patent discloses a tent having an image applied to an inside surface of the blind.

In addition, U.S. Pat. No. 5,345,961 to Yercha discloses a toy cardboard tent having indicia printed upon its outside surface, and U.S. Pat. No. 4,556,391 to Tardivel discloses an inflatable ship interior simulating play tent. An ocean sailing scene is displayed on the Tardivel tent as a backdrop to the simulated ship which includes a simulated ship's wheel, a compass pointer, and a simulated mast. The sailing scene may be viewed from both the exterior and interior of the tent. However, Tardivel does not disclose the manner in which the sailing scene is applied to the tent nor application of panoramic views to the tent and therefore does not provide a visual effect that virtually transports observers to the pictured scene.

SUMMARY OF THE INVENTION

The present invention relates to a panoramic tent having an inside surface and an outside surface comprising a plurality of flat, two dimensional sections attached together, wherein a panoramic image is displayed on the inside surface of the tent or both the inside and outside surfaces of the tent.

In an alternative embodiment, the tent may also comprise an overtent supported in a spaced relation exterior to the plurality of flat sections.

The present invention also relates to a method of making a panoramic tent which includes obtaining at least one image comprising a panoramic view and applying the image to the inside surface of the tent.

In addition, the present invention relates to a method of making a panoramic tent including the following steps: obtaining a plurality of images which composes a panoramic view; cutting the plurality of images into a plurality of section images; applying the plurality of section images onto a plurality of flat sections; and attaching the plurality of flat sections together to recreate the panoramic view. Preferably the images are photographs taken of a real life scene.

BRIEF DESCRIPTION OF THE DRAWINGS

Reference is next made to a brief description of the drawings, which are intended to illustrate a panoramic tent according to the present invention and steps of the method for making the panoramic tent. The drawings and detailed description which follow are intended to be merely illustrative, and are not intended to limit the scope of the invention as set forth in the appended claims.

DETAILED DESCRIPTION OF THE INVENTION

1. Tent

Figure 1:
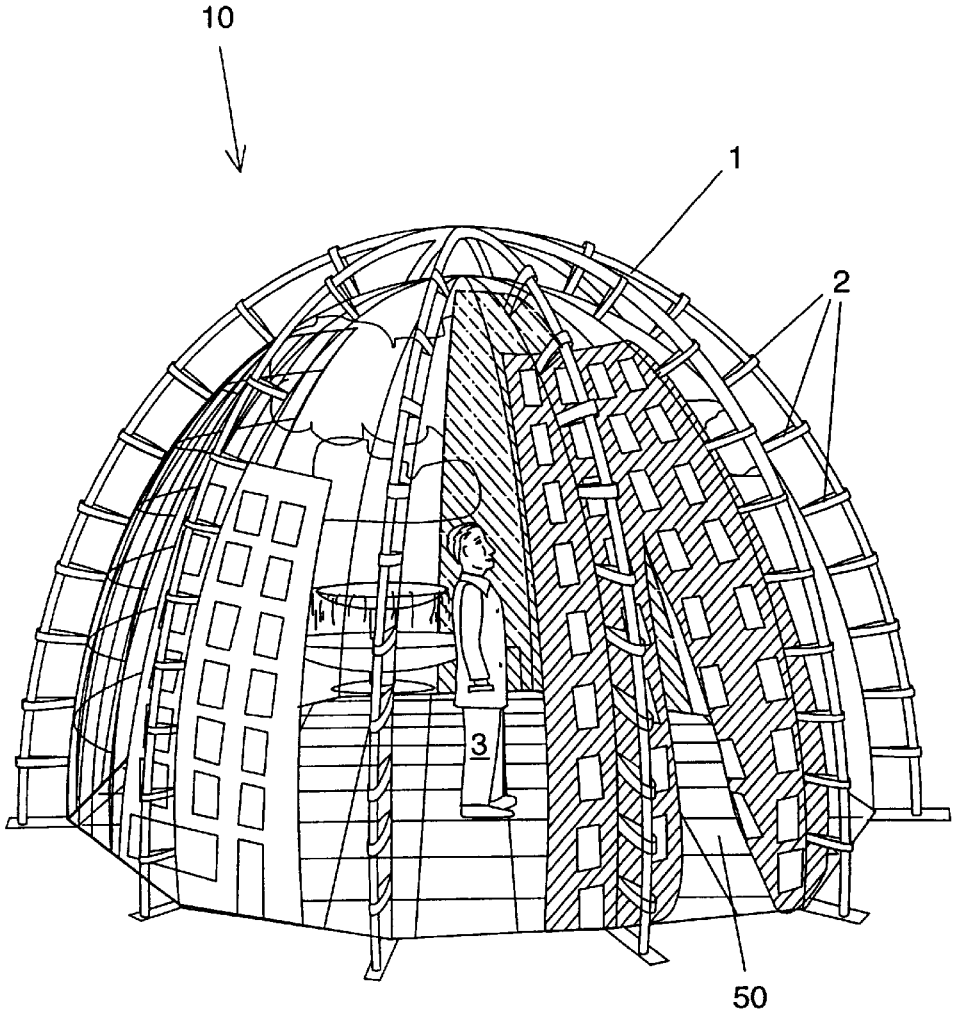
FIG. 1 shows a tent having a city scape on its inside and outside surfaces and an observer inside the tent. The tent is opaque. However, it has been depicted as transparent in order to show the interior detail of the tent.
Figure 2:
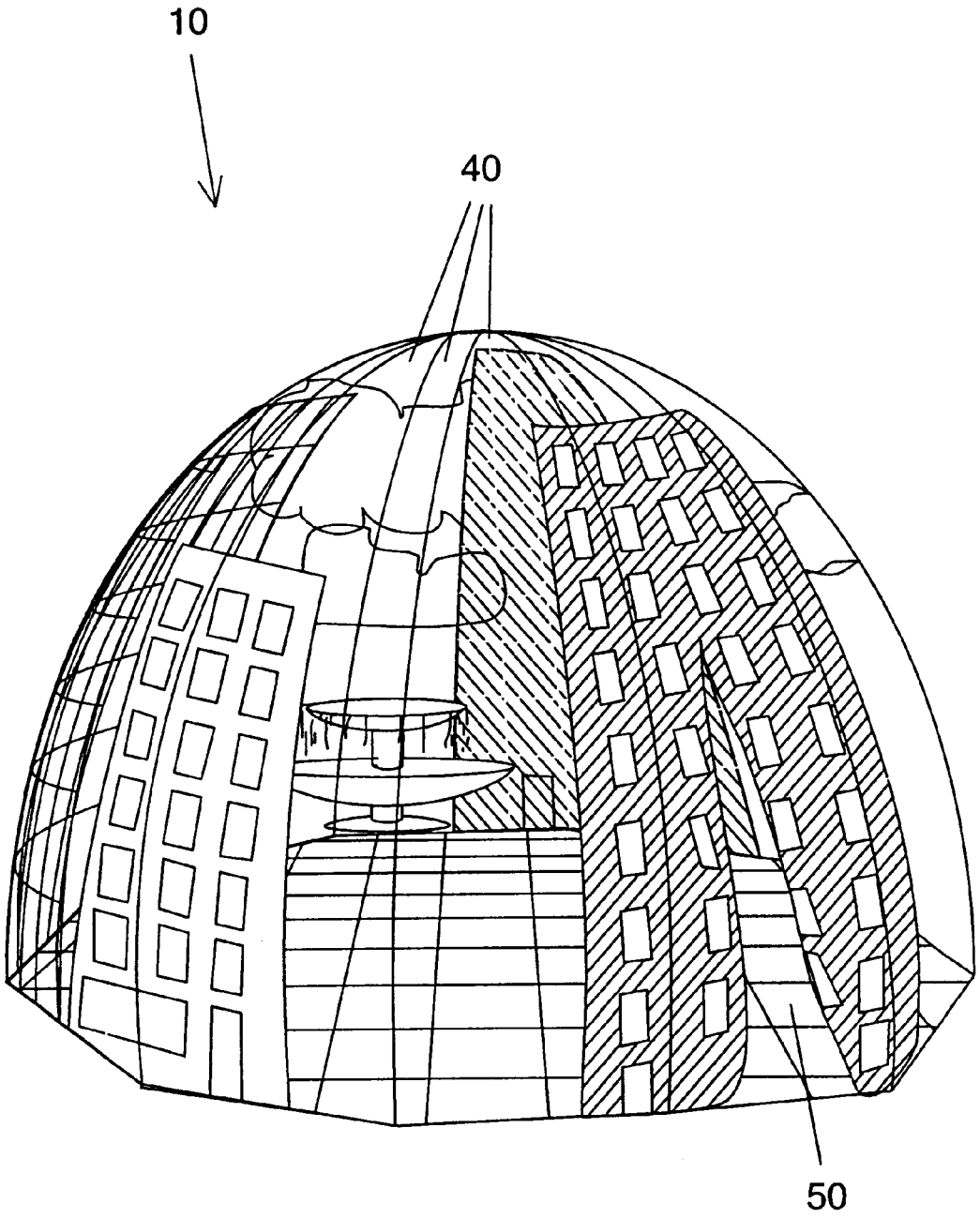
FIG. 2 shows the tent shown in FIG. 1 without a frame.

As shown in FIG. 1, tent 10 of the present invention surrounds observer 3 with a panoramic image of a city scene, thereby virtually transporting observer 3 to the city shown in the image. A panoramic image is an unbroken or continuous view of an entire surrounding area.

Figure 3:
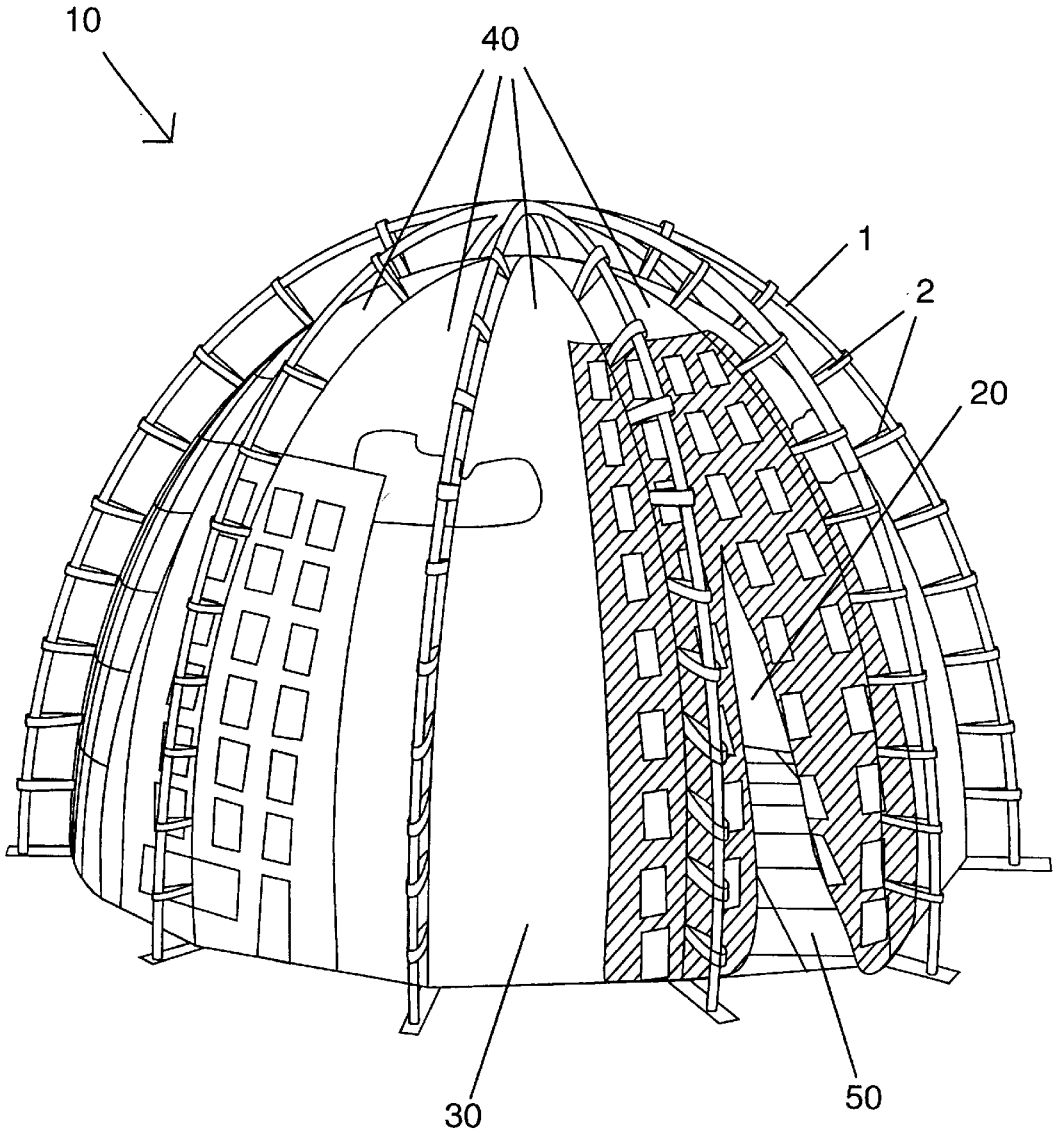
FIG. 3 shows another view of the tent shown in FIG. 1 including a frame and loops to hold the wall of the tent to the frame. This is an actual view of the opaque tent.
Figure 4:
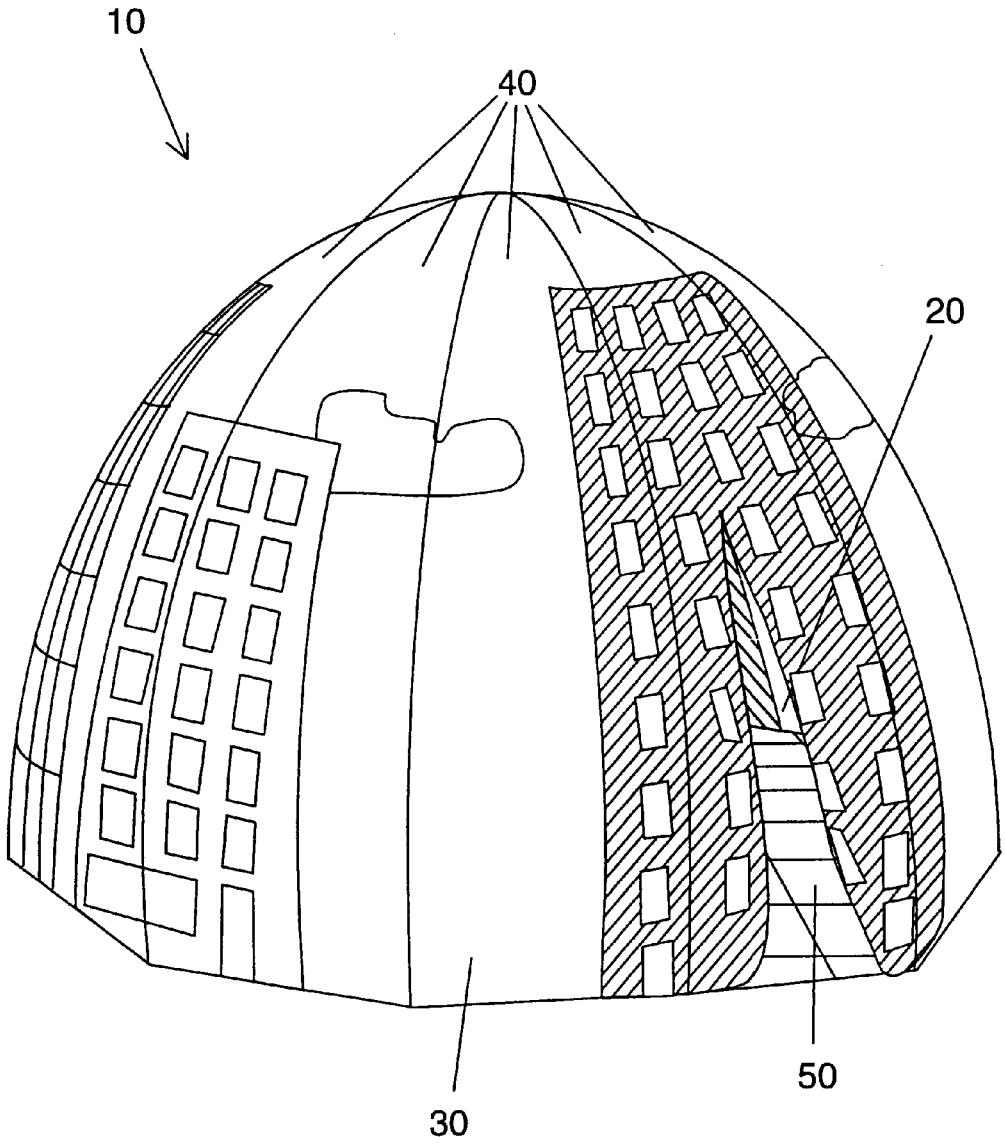
FIG. 4 shows another view of the tent shown in FIG. 1 without the frame.
Figure 6:
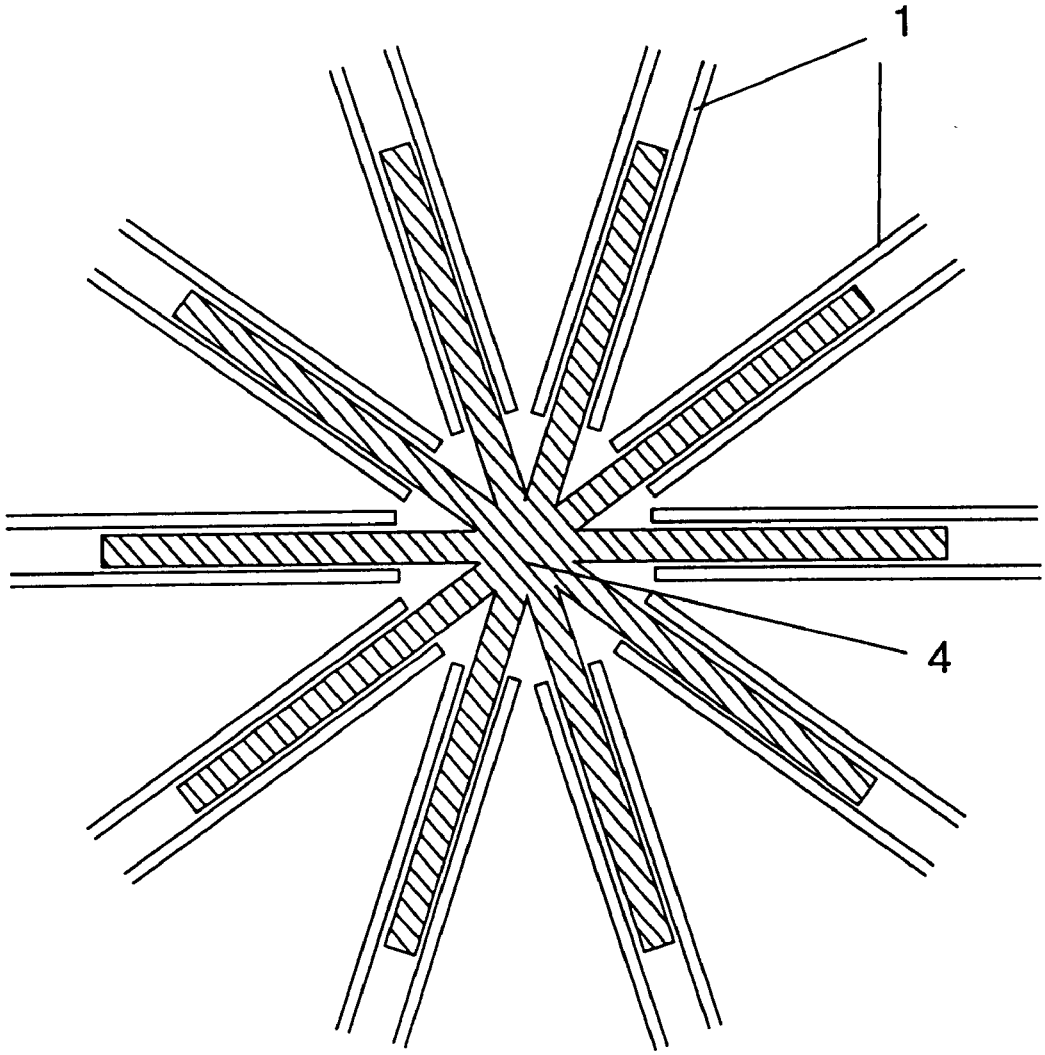
FIG. 6 shows the hub of the tent frame.

As shown in FIGS. 3 and 4, tent 10 has both an inside surface 20 and an outside surface 30 and comprises a plurality of flat sections 40 which are attached to each other. An image is applied to only inside surface 20 or both the inside and outside surfaces 20, 30 depending on the desired effect. This image is applied by an appropriate printing technique, thereby rendering a continuous panoramic 360° image to one or both surfaces 20, 30 of tent 10. This panoramic view may be extended all the way to the bottom section 50 of tent 10. It may even extend across the bottom section 50 of tent 10. As shown in FIGS. 1 and 3, tent 10 also comprises a structural frame 1 made of fiberglass rods, which are connected to tent 10 by means of loops 2. Loops 2 are attached to flat sections 40, as by sewing, and they are preferably made of fabric. Frame 1 may also be made of appropriate alternative materials, such as aluminum. In an alternative embodiment, tent 10 may be inflatable. Frame 1 is held together at the top of tent 10 by hub 4. As shown in FIG. 6, hub 4 comprises tubular steel spokes, which fit within the hollow fiberglass rods of frame 1.

Flat sections 40 of tent 10 may be made from a wide variety of natural and synthetic materials. For example, flat sections 40 may be made of cloth, plastic, or sheets of photographic film. Preferably, polyesters will be used, but other materials such as nylon fabrics or polyvinyl plastics may also be used. Flat sections 40 also may include reinforcement materials.

As shown in FIGS. 1–4, flat sections 40 are attached to each other to form the tent walls, which are also attached to bottom section 50 to form tent 10. Preferably, these pieces are sewn together. In the case of flat sections 40 and bottom section 50 are constructed of vinyl, these pieces may be heat sealed. Any other appropriate means of attaching known in the art may alternatively be used.

Figure 14A:
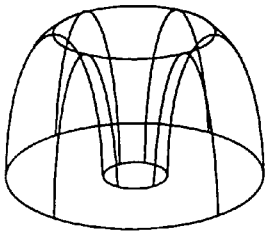
FIG. 14*a* shows an alternative tent structure.
Figure 14B:
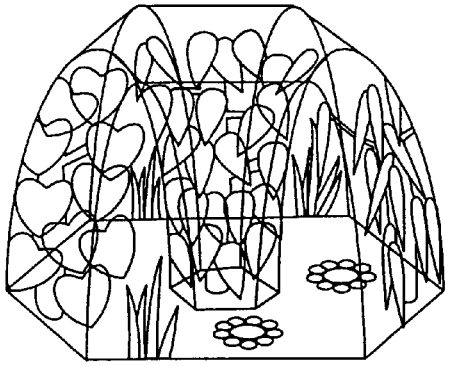
FIG. 14*b* shows the alternative tent structure of FIG. 14*a* including a garden scene.
Figure 14C:
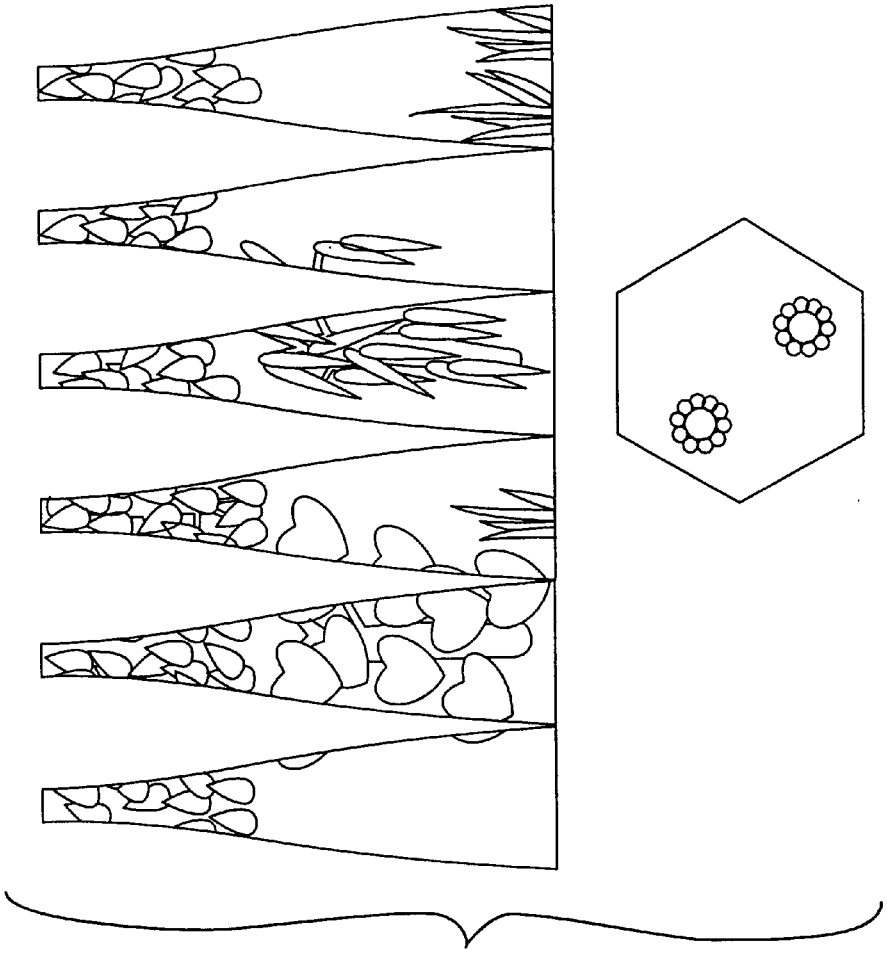
FIG. 14*c* shows the flat sections and the bottom section of the tent shown in FIGS. 14*a* and 14*b*.

The shape of tent 10 is part of its illusion, and the number of flat sections 40 may vary depending on the desired shape and effect. A variety of tent designs or shapes may be incorporated into the present invention. One example of such an alternative design is shown in FIGS. 14*a–c*. These shapes may be regular geometric shapes, such as cones, or irregular shapes. In addition, flat sections 40 may also be made in a variety of shapes. Flat sections 40 pictured in FIGS. 1–4 extend vertically from bottom section 50 to the top of tent 10. Alternatively, flat sections 40 may comprise horizontal pieces which are attached one on top of the next from the bottom section 50 to the top of tent 10.

The preferred printing technique is a photographic transfer method such as dye sublimation printing, inkjet printing, or any other method of digital application, or more conventional methods such as silk screening and offset printing. In digital printing, film is not required. In silk screening, ink is pressed through a silk screen, and in offset printing, ink on a metal plate is pressed to the substrate. However, other appropriate printing techniques may also be used.

The image displayed on the outside surface of the tent may be different than the image displayed on the inside surface of the tent, thereby providing a different view to observers depending on their position relative to the tent. However, it is preferred that the image on the outside surface of the tent is a mirror image of the identical image that is on the inside surface of the tent. It is also preferred that the two images are in register. If not, the images may conflict with each other, particularly when the flat sections which compose the tent are made of transparent or translucent materials or materials which are not entirely opaque. Applying one image to one surface of the test and its mirror image on the other surface in register with the first image increases the intensity of the image.

The tent is intended to be used in conjunction with light, either natural or artificial. The tent may be placed outdoors, e.g., for camping, or within a room with windows, and the effect of the tent may be enjoyed either by sunlight, starlight, or moonlight. Alternatively, an artificial light may be provided either outside or inside the tent. A dimmer may be provided with the artificial light to achieve ideal luminescence. The effect of the light shining through the tent is similar to the effect of a stained glass window, a photographic transparency, or a backlit billboard.

A tent having an image displayed on both the inside and outside is preferable particularly when lighting outside the tent is available because this increases the intensity of the image viewed by one inside the tent.

Figure 7:
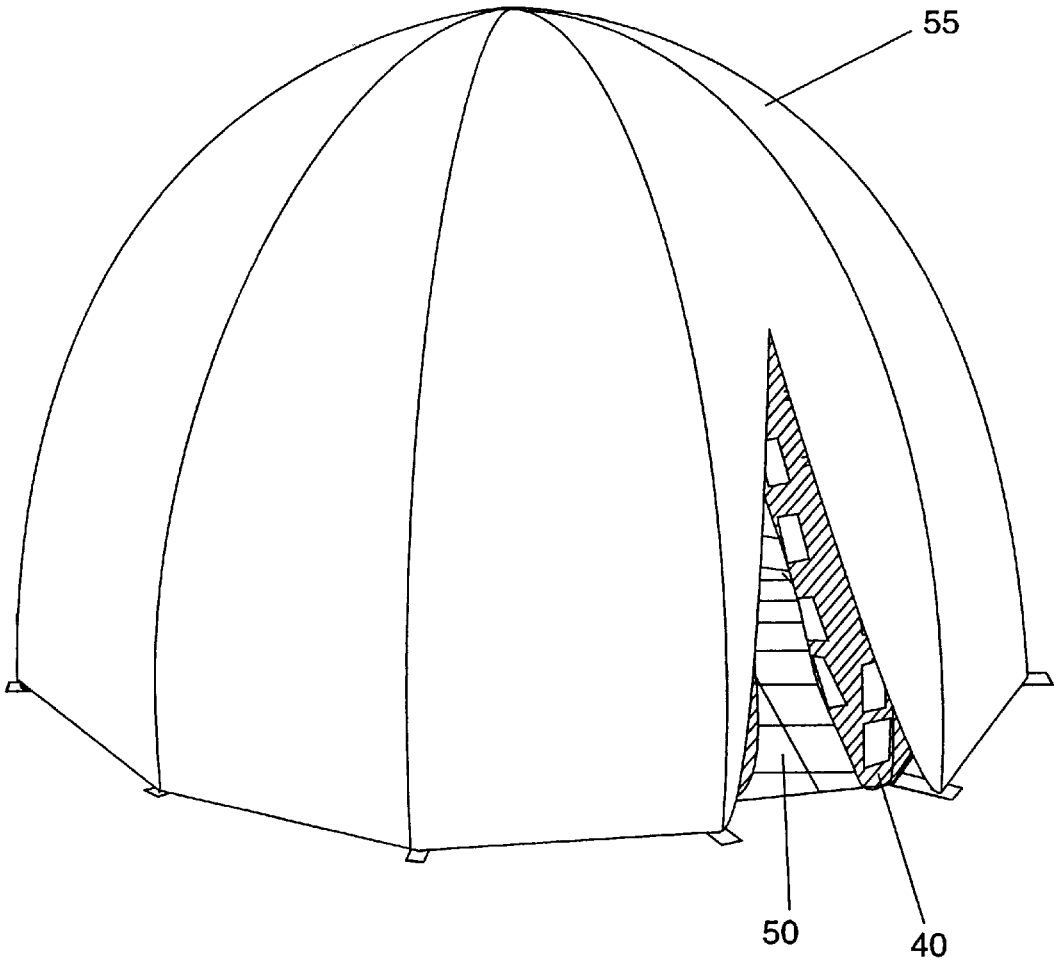
FIG. 7 shows an alternative embodiment of the tent including an overtent.

When the tent is to be used outdoors or in very well lit spaces, an overtent 55 may be used to achieve even lighting and the ideal luminescence as shown in FIG. 7. Overtent 55 would be placed over tent 10, between the light source and tent 10. Overtent 55 is preferably white and made from nylon, polyester, PVC, or any other material with the desired opacity. The thickness of overtent 55 can be varied to control the amount of light entering. This effect is comparable to a photographic lightbox with the sun being the light source. If an overtent 55 is used, one would not be able to see the image from outside tent 10, and therefore the image would remain a surprise until an observer stepped inside tent 10.

The tent of the present invention may be used for educational purposes. Images or pictures may be taken of places of interest which are not easily accessible either due to distance, expense, natural obstacles, legal obstacles, or other reasons. The pictures composing the image could then be printed on one or both surfaces of a tent for viewing in a more accessible location. This would give students, museum-goers, and others the chance to virtually enter the places represented in the image. Instead of a picture book, which offers only a partial view, the tent of the present invention provides a complete surrounding visual experience.

The present invention also may be used to preserve endangered places. For example, one could photograph the caves of Lascaux in France where prehistoric paintings have been damaged by visitors who breathe on them, thereby changing the atmosphere of the caves. These caves have had to be closed to the public. However, the paintings may still be viewed with the tent of the present invention. A 360° panoramic picture may be taken of this site, then printed on a dome shaped tent. This tent may then be transported to any site around the world, and shown in museums or other places without further harming or endangering these historically significant paintings.

The invention may also be used for entertainment purposes. For example, a fantasy world such as a science fiction space station, may be created digitally, then applied to one or both surfaces of a tent. Observers may then view this tent for enjoyment, thereby enriching their imagination.

Those of ordinary skill in the art will appreciate that tents of the present invention may be made of any size. A small tent may be made for viewing by only one or a few people. In addition, small tents may be made for children. A mid-sized tent may be made for viewing by up to twenty people, or a large tent may be made for viewing by fifty people or more. A preferred size tent is thirteen feet high and thirteen feet in diameter. The frame of the tent will vary depending on its size. Smaller tents will be supported by rods of aluminum, fiberglass, or other appropriate materials, and larger tents will be supported by metal structures and steel cables.

Figure 8:
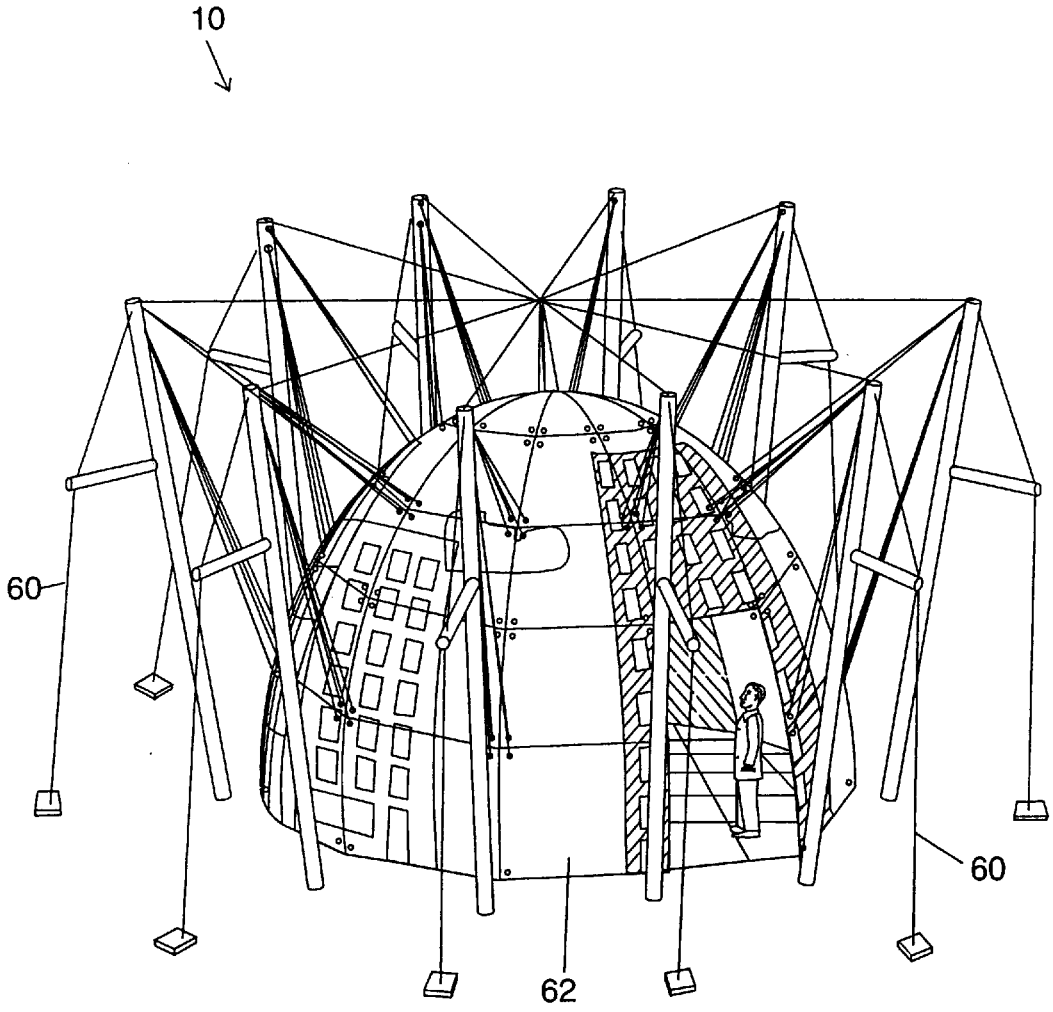
FIG. 8 shows an alternative embodiment of the tent, wherein the panoramic image is sandwiched between two pieces of clear material.
Figure 9:
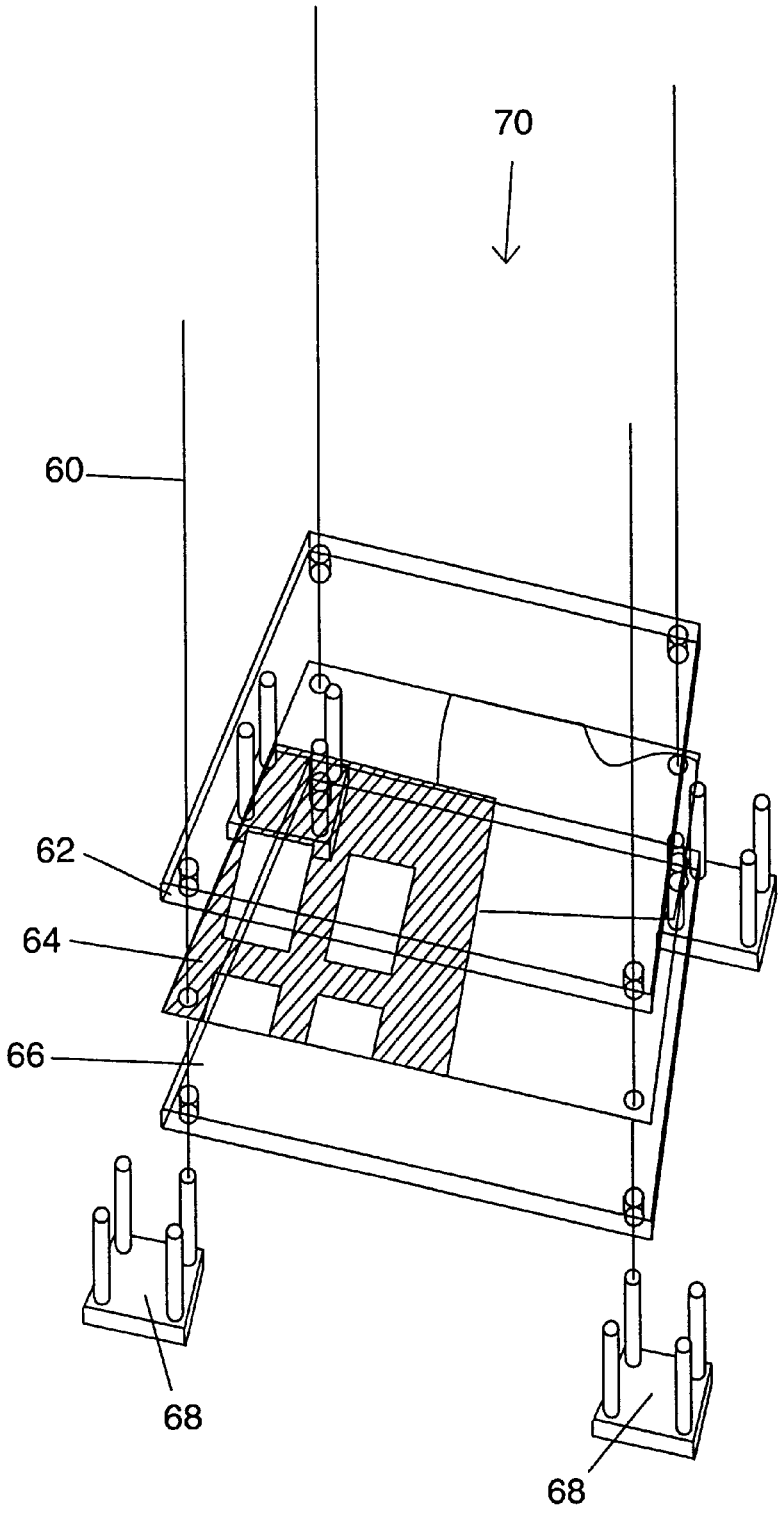
FIG. 9 shows a segment of the alternative embodiment shown in FIG. 8.

In an alternative embodiment, the image may be applied to a soft material, which is then sandwiched between two clear transparent materials, which provide the necessary rigidity to the tent as shown in FIGS. 8 and 9. Examples of such clear materials are glass or plexiglass. In addition, the outer clear rigid material can be frosted such as, for example, sandblasted glass.

A segment 70 of the alternative embodiment shown in FIG. 8 is illustrated in FIG. 9. As shown in FIG. 9, a portion of the panoramic image is applied to flat sandwich section 64, which is located between outer plate 62 and inner plate 66. Each flat sandwich sections 64 and its corresponding plates 62, 66 are maintained in position by cables 60, and groups of segments 70 are maintained in position by each corner piece 68.

Observing the panoramic view of the present invention may be both interesting and educational and may also offer aesthetic pleasures. Tent 10 may be used both for camping and for display in public spaces such as museums and lobbies. Tent 10 may also provide a relaxing atmosphere and distraction from everyday work and familiar scenes.

2. Method for Making Tent

Figure 10:
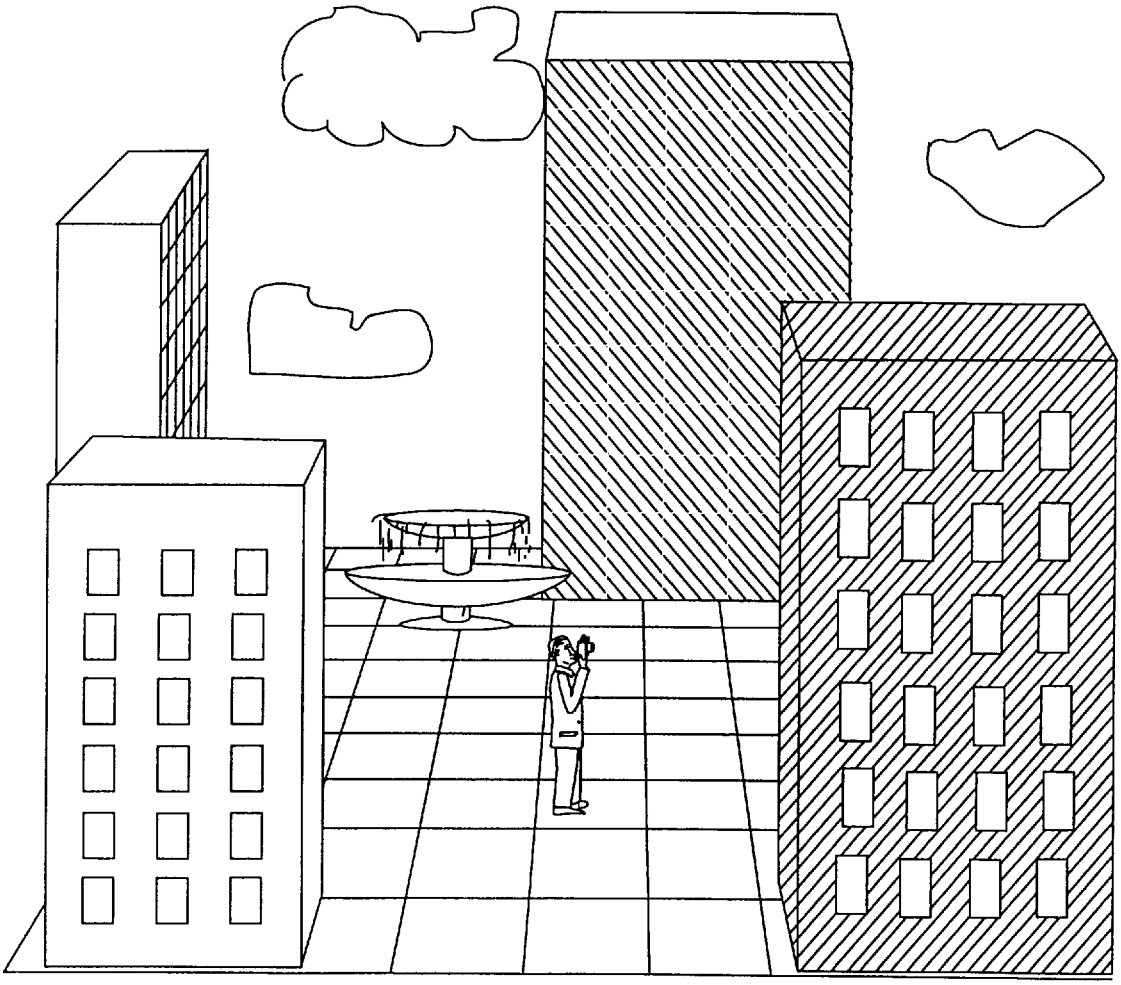
FIGS. 10–13 depict steps in the method of the present invention.
Figure 11:
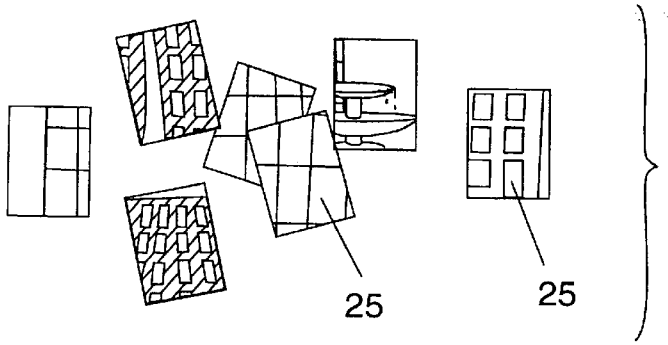

Once a place, such as a rainforest or crystal caves in New Mexico, has been chosen, a plurality of images or pictures 25 are taken as shown in FIG. 10 and developed as shown in FIG. 11. Preferably, images 25 are photographs of the real space. It is helpful to determine the desired shape of tent 10 before obtaining the images. By keeping in mind the shape of the tent, the images may be obtained more effectively. Pictures 25 may be any size, such as 4"×6" or 5"×7". Each of the pictures 25 shows a partial view of the complete panorama, and the number of images must be sufficient to cover the complete panoramic view, including the ground or floor if desired. Distortion at the edges of each picture 25 may be avoided by, for example, use of a normal lens (50 mm for 35 mm format cameras, 80 mm for 120 mm format cameras, etc.) or larger (e.g., a telephoto lens). It is preferable to use the same lens to take all of the pictures. It is possible to do this in any photographic format, including, but not limited to, 35 mm and 120 mm. In addition, the pictures 25 may be in color or they may be black-and-white. Pictures 25 may be obtained in a variety of alternative ways. For example, they may be obtained using digital photography, videography, or any other visual image capturing technique.

Figure 12:
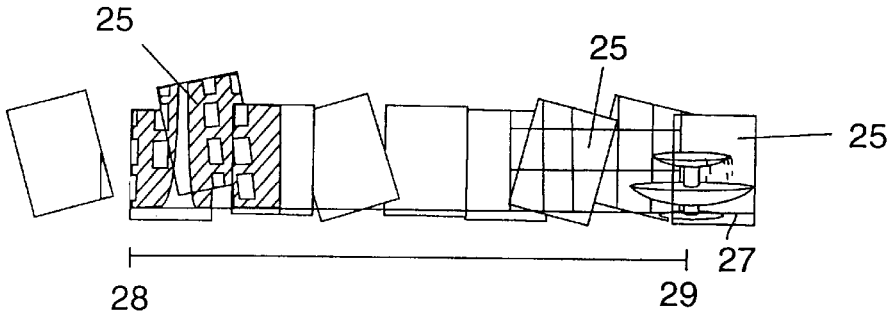
Figure 13:
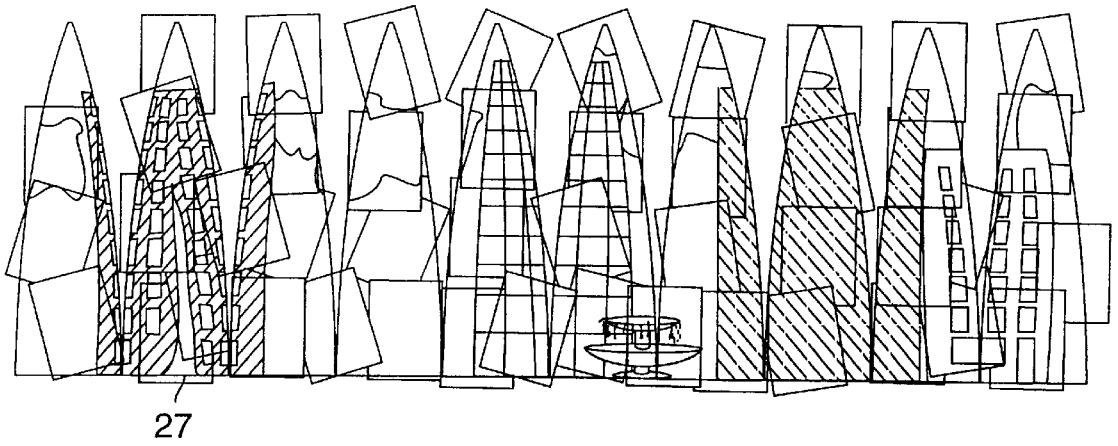

Next, one determines the location of horizontal line 27, which represents the line at which the flat sections 40 composing the tent walls meet the bottom section 50 of that 10. For example, as shown in FIGS. 12 and 13, one may choose to place horizontal line 27 along the bottom of the buildings of the city scape. Pictures 25 showing the bottom of the building are then arranged to form a continuous image, and horizontal line 27 is then marked on these pictures as shown in FIG. 12. Line 27 may be marked with chalk, thread, or other appropriate marking device.

As further shown in FIG. 12, one then determines and marks two opposing points 28, 29 along horizontal line 27, which will ultimately be 180° apart in the final tent. The distance along horizontal line 27, between opposing points 28, 29 is half the circumference of the circle, which represents the intersection between the panoramic view shown in the pictures 25 and the ground or floor.

A three-dimensional mold or model is then built on which to arrange pictures 25. The model should be large enough so that all the pictures 25 may be arranged on it to show a continuous image. However, it need not be the same size as tent 10. The model's size is determined by the distance between opposing points 28, 29, which is half the circumference of the model's circular base. This distance divided by $\pi/2$ will be the diameter of the model base. The three-dimensional model comprises a plurality of flat sides, having shapes corresponding to the flat sections 40 of tent 10. A dome or globe shape may be achieved by increasing the number of flat sections 40, and preferably, tent 10 should comprise at least six flat sections 40. However, fewer than six flat sides may be desired in certain circumstances. For example, four flat sides may be used if a panoramic view of a room is desired. In addition, the number of flat sides may be limited by the size of the final tent. The more flat sections a tent has, the more seams it will also have, and this may be undesirable, especially in a small tent.

The model may be made of cardboard, styrofoam, or other inexpensive materials that may be easily molded or shaped. A thin flexible material, such as paper, is laid over the entire outer surface of model by any impermanent attachment means known in the art. The thin flexible material is cut into sections, and each section corresponds to or is geometrically similar to the corresponding flat sections 40 of tent 10. The pictures 25 are arranged and then adhered to the paper cover to form a continuous panoramic view on the outside surface of the model. The pictures 25 are adhered using tape, glue, wax, or other appropriate attaching means known in the art. Alternatively, the paper cover and pictures 25 may be attached to the inside surface of the model. However, this may be difficult, particularly if the model is small.

One way to arrange the pictures 25 is to begin at the bottom with the photos 25 that have been marked with horizontal line 27, and then to work to the top. When all the pictures 25 have been arranged to match their images and to form a continuous view, the arrangement of pictures 25 are cut into model pieces. Each model piece therefore comprises two layers, one layer consisting of a portion of the complete panoramic view and the other layer consisting of the paper which provides a backing.

The model pieces are laid out flat and may then be scanned into a computer, thereby creating section images. These section images may be retouched to smooth out or to otherwise perfect the image. Software is available which allows a user to match up the images within each section image. Tape marks or imperfections in the section images may also be retouched. In addition, gaps may be filled in, such as by copying portions of images in other pictures. For example, if part of a tree is missing, sections of another tree from another photograph may be copied into the gap of the incomplete tree. The image resolution is limited only by existing technology. In addition, colors may be added or altered. There are various alternative modifications known in the art, which can be made to the section images with the help of existing software.

Figure 5:
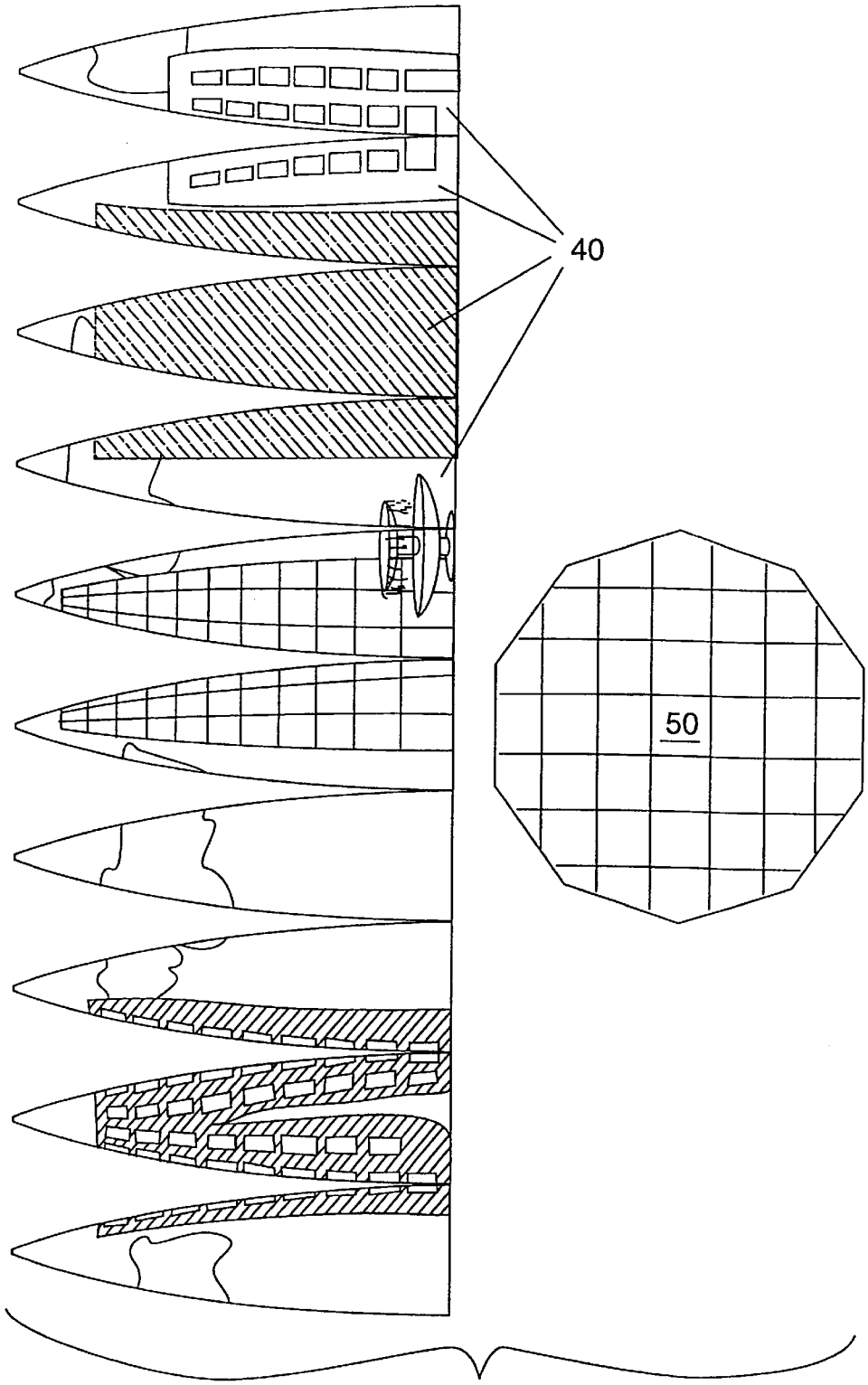
FIG. 5 shows the flat sections and the bottom section which make up the walls of the tent.

The section images are next applied to the flat sections 40 of tent 10 as shown in FIG. 5. In addition, images of the ground or floor optimally may be applied to bottom section 50 of tent 10. Application of section images may be done at existing computer output places and affected by any means known in the art. This includes any appropriate transfer methods or direct printing methods. The section images may need to be enlarged before actual application. Preferably, the section images will be applied to polyester flat sections 40 using a transfer method called dye sublimation printing.

In dye sublimation printing, the section image is output to a transfer sheet by electrostatically charging the sheets and then applying dye particles, which are only a few microns large. The transfer sheet is then pressed against a flat section 40 while heat is applied. The section image is thereby transferred to the flat sections 40. In order to create a tent having mirror images on the inside and outside surface, two transfer sheets are used. The image is output to one of the transfer sheets, and its mirror image is output to the other transfer sheet. The flat section 40 is sandwiched between the transfer sheets, and the entire assembly is pressed together while heat is applied.

An alternative method of applying the image is direct printing, such as inkjet printing. This method may be used on any type of material, including vinyl, and is achieved by spraying jets of ink onto flat sections 40 using multiple printheads. Other alternative methods include silk screening and offset printing.

Figure 15:
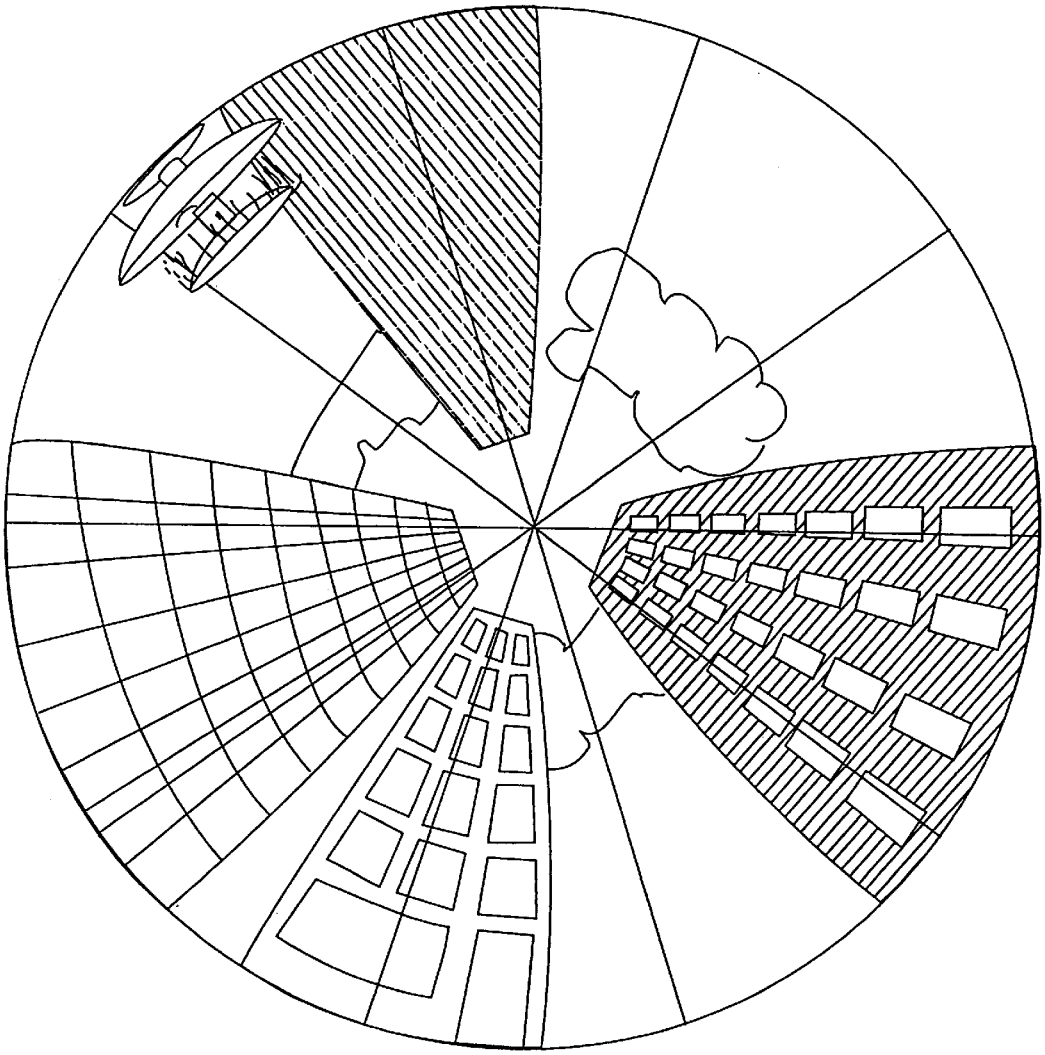
FIG. 15 shows an image obtained with a 180° wide-angle lens.

An alternative method of making the tent includes the use of a camera having a 180° wide-angle lens. The camera would be pointed directly up to the sky in the chosen place. As shown in FIG. 15, the single picture taken would include the entire panoramic view to be applied to the tent walls. This single picture would be scanned into the computer, which would assist the user in creating the appropriate section images to be applied to the flat sections of the tent. These section images would be formed using a mathematical formula of the optics of the 180° lens used, to give the section images the correct perspective according to the desired shape and size of the tent. Using a 180° lens therefore simplifies the method for making the tent. Taking only one picture of the entire panoramic scene eliminates the need for a model and the step of arranging the pictures on the model.

An alternative method of obtaining the panoramic image is to generate the image with a computer. Software may be used both to generate the image and then to manipulate the generated image to obtain section images to be applied to the flat sections of the tent. The section images may be modified so that the panorama ultimately viewed by the observer will be realistic and perspectively accurate. Modification may be required even of fantasy images to add photographic touches.

In addition, the pictures may be taken from within a wire frame model, on which the pictures will ultimately be arranged. This will minimize the amount of retouching that will need to be done later.

The present invention may be embodied in other forms or steps without departing from its spirit or essential characteristics. The described embodiments are to be considered only as illustrative and not as restrictive. The scope of the invention is, therefore, indicated by the appended claims.

What is claimed:

1. A panoramic tent having an inside surface and an outside surface and comprising a plurality of substantially flat sections attached together, wherein a first photographic facsimile of a real space is printed on substantially the entire inside surface of the tent.

2. The panoramic tent of claim 1, wherein a second photographic facsimile of a real space is printed on substantially the entire outside surface of the tent.

3. The tent according to claim 2, wherein the first photographic facsimile is a mirror image of the second photographic facsimile.

4. The tent according to claim 3, wherein the first photographic facsimile is in register with the second photographic facsimile.

5. The tent according to claim 1, further comprising a bottom section attached to the plurality of substantially flat sections.

6. The tent according to claim 1, further comprising a frame and a plurality of loops connecting the frame to the plurality of substantially flat sections.

7. The tent according to claim 1, wherein the plurality of substantially flat sections are made of polyester.

8. The tent according to claim 1, wherein the first photographic facsimile is applied to the plurality of substantially flat sections by dye sublimation printing.

9. The tent according to claim 1, wherein the first photographic facsimile image is silk screened onto the plurality of flat sections.

10. The tent according to claim 1, wherein the first photographic facsimile comprises a view of the Lascaux caves.

11. The tent according to claim 1, wherein the first photographic facsimile comprises a computer generated image.

12. The tent according to claim 1, further comprising an overtent supported in a spaced relation exterior to the plurality of flat sections.

13. The panoramic tent according to claim 1, wherein the flat sections of the tent are made of a translucent material.

14. The panoramic tent according to claim 13, wherein the translucent material is at least one of polyester, nylon, dacron, glass, and film.

15. A panoramic tent defining an interior space, wherein the tent comprises:

a plurality of substantially flat sections, wherein each flat section has an inside surface and an outside surface; and an image permanently displayed on the inside surface of each flat section, wherein the plurality of flat sections are attached together such that the images displayed on the inside surfaces thereof combine to create an inner, substantially continuous facsimile of a real space visible to a person within the interior space of the tent.

16. The panoramic tent of claim 15, further comprising an image permanently displayed on the outside surface of each flat section, wherein the plurality of flat sections are attached together such that the images printed on the outside surfaces thereof combine to create an outer, substantially continuous facsimile of a real space visible to a person outside the tent.

17. The tent according to claim 16, wherein the inner, substantially continuous facsimile is a mirror image of the outer, substantially continuous facsimile.

18. The tent according to claim 17, wherein the inner, substantially continuous facsimile is in register with the outer, substantially continuous facsimile.

* * * * *